United States Patent [19]

Kirk et al.

[11] 3,941,631

[45] Mar. 2, 1976

[54] PAPER ART PROCESS

[76] Inventors: James Robert Kirk; Lark Warren Kirk, both of 272 Beacon St., Apt. 3, Somerville, Mass. 02143

[22] Filed: July 25, 1974

[21] Appl. No.: 491,947

[52] U.S. Cl. ..... 156/59; 35/26; 63/2.32; 156/63; 156/250; 428/15

[51] Int. Cl.[2] ..... B44C 3/02

[58] Field of Search ..... 156/59, 63, 250; 161/19–34, 7, 9; 63/2.32; 35/26; 46/115, 151; 428/15

[56] References Cited

UNITED STATES PATENTS

| | | | |
|---|---|---|---|
| 1,315,488 | 9/1919 | Franklin | 161/109 |
| 1,839,889 | 1/1932 | Palais | 46/157 |
| 3,268,379 | 8/1966 | Baker | 156/63 |
| 3,301,725 | 1/1967 | Frontera | 35/26 |

OTHER PUBLICATIONS

Edward Lopkoff, "Striped Heart Is Built Of Laminated Sheets," Feb. 1946 p. 97.

*Primary Examiner*—Edward G. Whitby
*Attorney, Agent, or Firm*—Clarence A. O'Brien & Harvey B. Jacobson

[57] ABSTRACT

A three-dimensional, ornamental product is made by cutting a two-dimensional design out of a planar laminate and abrading the design into the final three-dimensional shape of the product, thereby exposing the different layers of the laminate in an exterior surface pattern. The laminate is formed from multicolored sheets of paper.

3 Claims, 5 Drawing Figures

PAPER ART PROCESS

This invention relates to the making of ornamental or artistic objects such as pendants, costume jewelry, wall hangings, etc.

An important object of the present invention is to provide a method of making an ornamental or artistic product in a relatively simple manner permitting the artisan to express himself artistically utilizing relatively inexpensive materials.

The method of the present invention involves the use of sheet material to form a laminate from which a desired design is cut and which is then abraded in order to form the final shaped product. The making of products from laminated materials is generally known as disclosed in the following patents of which applicant is aware: U.S. Pat. Nos. 268,469, 298,358, 1,315,488, 1,469,554, 2,903,390, and 3,123,919.

In accordance with the present invention, a plurality of differently colored and therefore visually distinguishable sheets of construction paper are laminated by means of an adhesive to form a flat planar panel from which a desired design is cut out along a two-dimensional outline. Material is then removed from the cut out design by various abrading means in order to form the final three-dimensional product. The removal of material from the cutout design also exposes the different layers of the laminate in an exterior surface forming a multi-colored surface area pattern. The final product is then coated with a transparent, waterproofing material.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
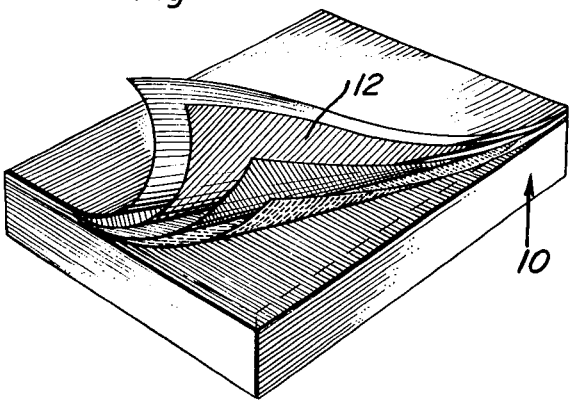
FIG. 1 is a perspective view showing the formation of a laminated panel of colored sheets of paper as the initial step of the present invention.

Referring now to the drawings in detail, FIG. 1 illustrates a flat panel generally referred to by reference numeral 10 made from a plurality of sheets of visually distinguishable material such as differently colored, non-metallic construction paper 12. The sheets of paper are laminated to a thickness of ⅜ inch for example by use of a commercial adhesive such as a latex base glue which is applied as a coating between the sheets of the paper. In one example, 30 sheets of differently colored construction paper, 9 inches × 12 inches in dimension are laminated to the thickness of ⅜inch. After the adhesive is applied to the sheets, the resulting laminate panel is left to dry to a hard finish.

Figure 2:
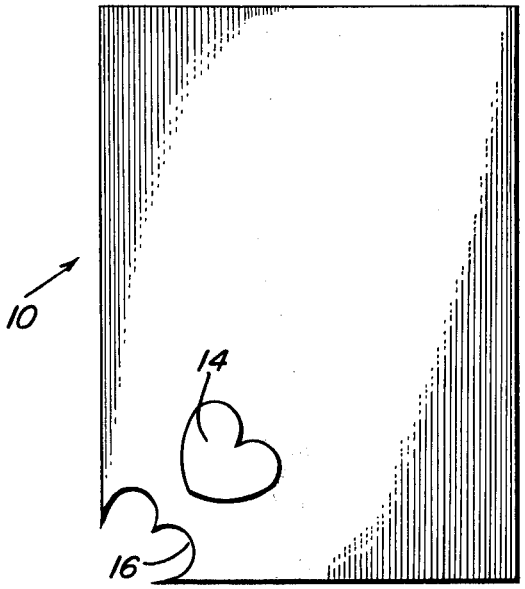
FIG. 2 is a top plan view of the laminate panel from which a desired design is cut out.
Figure 3:
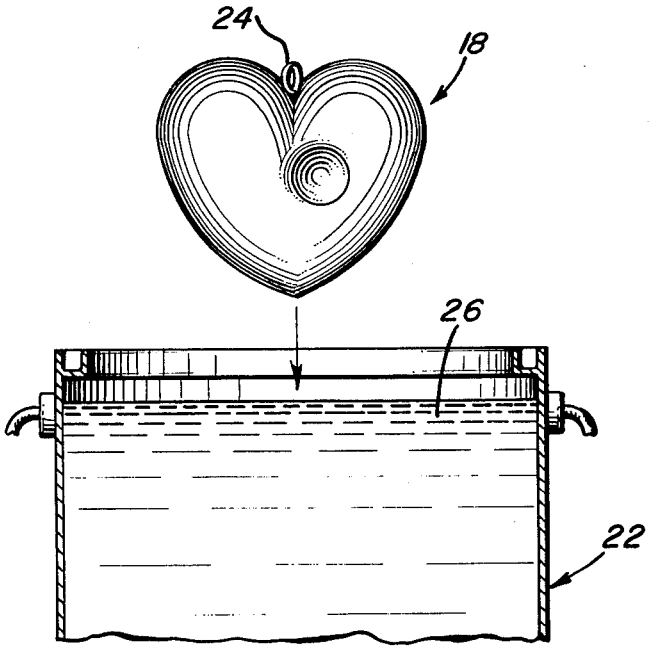
FIG. 3 is a front sectional view showing the coating of the final product constructed in accordance with the present invention.
Figure 4:
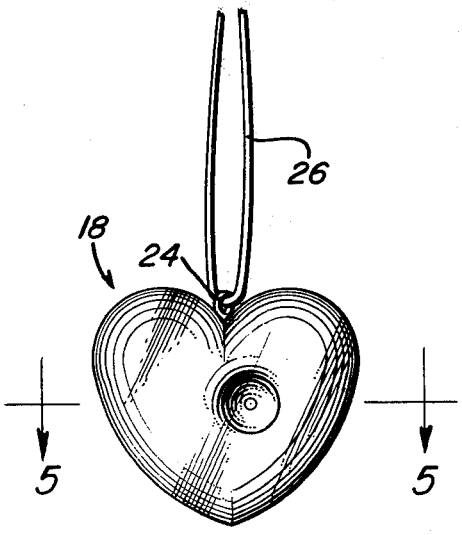
FIG. 4 is a front elevational view of a final product constructed in accordance with the present invention.
Figure 5:
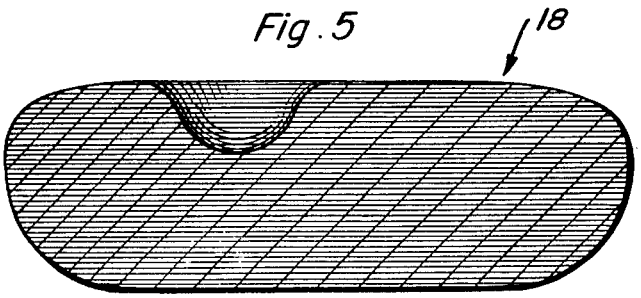
FIG. 5 is an enlarged transverse sectional view taken substantially through a plane indicated by section line 5—5 in FIG. 4.

As shown in FIG. 2, the next step in making the product in accordance with the present invention, involves the cutting out of a desired design such as a two-dimensional heart shaped configuration 14 along a two-dimensional outline 16 in a plane parallel to the laminate 10. The shape of the design 14 will of course correspond to the projection of the final product on a front view plane. Material is then removed from the two-dimensional configuration or design 14 in order to form the final three-dimensional product 18 as shown in FIG. 4. The cutting of the intermediate design configuration 14 from the panel 10 may be accomplished by use of a coping saw whereas the removal of material from the design in forming the final product shape, may involve the use of sandpaper, wire wheels and other abrasive tools. After the final product shape has been formed and a final fine surfacing operation has been performed, the product is protectively coated with a light transmissive coating such as a clear plastic floor finishing compound 20 within container 22 as illustrated in FIG. 3. In one embodiment of the invention, a threaded eye is secured to the product 18 by means of which it may be suspended and dipped into the coating 20 which may be in the form of a clear plastic floor finishing compound. Initially, three coats of plastic finish are applied, allowing 1 hour of drying time between each coating. Three more coats are again applied in the same manner after elapse of 24 hours. After another 24 hours, three more coats of finishing material are applied by dipping the product into the body of coating material 20 upside down. Two final coats of coating material are applied by dipping the product again right side up after elapse of 24 hours between each dipping. The finished product is then allowed to dry harden for approximately 120 hours.

In removing material from the cut-out design 14 as shown in FIG. 2, various layers or sheets 12 of the laminate panel 10 are exposed at the final exterior surface of the product 18. The relative areas of the exposed sheets or layers and the contrasting combinations of colors associated therewith will depend on the extent of the material removed and the angular variations of the abraded surfaces relative to the plane of the original panel 10 from which the intermediate design configuration 14 is cut. Thus, by hand controlled abrasion of the cut out design 14, an artisan may shape the final product 18 to a unique multi-colored exterior surface pattern.

In the embodiment illustrated, the product 18 is a pendant suspended from a leather thong or chain 26 anchored to the "eye" 24 by means of which the product was dipped in the body of protective coating 20. The coating will make the product waterproof and camouflage the fact that it is made of paper.

Although the product shown in the drawings is a pendant, it will be appreciated that other ornamental objects could be made by the same method including costume jewelry, and wall hangings, by way of example. An unlimited variation of color patterns is made available to the artist not only by the selective exposure of different layers 12 of the laminate 10 during the three-dimensional shaping of the cut out design 14, but also by the selection and arrangement of colored sheets 12 in the formation of the laminate 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method of making an ornamental device comprising the steps of:

a. adhesively securing a plurality of sheets of distinguishably colored construction paper in overlying relation to form a laminate having planar top and bottom surfaces, b. drying the laminate into a rigid, hard panel, c. cutting the laminate along a predetermined outline in perpendicular relation to the top and bottom surfaces to form a cut-out, d. removing material from the cut-out at predetermined areas to reveal portions of at least some of the sheets disposed inwardly of the outer sheets of the cut-out, e. coating the cut-out with a clear waterproof material, and f. the step of beveling and rounding the peripheral edge of the cut-out to reveal the side edge of the sheets of paper as distinguishably colored peripheral stripes visible from both the top and bottom of the object.

2. The method as defined in claim 1 wherein said step of removing material also includes the step of removing material from the planar surface of the cut-out to form a tapering depression therein to reveal a portion of several underlying sheets of paper as distinguishably colored stripes peripherally of the depression with the bottom of the depression revealing a solid portion of an underlying sheet coinciding with the depth of the depression.

3. The method as defined in claim 2 wherein said coating step includes multiple steps of dipping the cut-out into a quantity of coating material with each layer of coating allowed to dry, and attaching a supporting eye to the peripheral edge of the cut-out prior to coating to enable support of the finished object.

* * * * *